US011958103B2

(12) United States Patent
Ina et al.

(10) Patent No.: US 11,958,103 B2
(45) Date of Patent: Apr. 16, 2024

(54) INORGANIC COATED SAND

(71) Applicant: KAO CORPORATION, Tokyo (JP)

(72) Inventors: Yoshimitsu Ina, Toyohashi (JP); Masayuki Kato, Toyohashi (JP)

(73) Assignee: KAO CORPORATION, Tokyo (JP)

( * ) Notice: Subject to any disclaimer, the term of this patent is extended or adjusted under 35 U.S.C. 154(b) by 614 days.

(21) Appl. No.: 17/258,514

(22) PCT Filed: Jun. 24, 2019

(86) PCT No.: PCT/JP2019/024948
§ 371 (c)(1),
(2) Date: Jan. 7, 2021

(87) PCT Pub. No.: WO2020/012934
PCT Pub. Date: Jan. 16, 2020

(65) Prior Publication Data

US 2021/0268570 A1 Sep. 2, 2021

(30) Foreign Application Priority Data

Jul. 9, 2018 (JP) ..... 2018-130190

(51) Int. Cl.
*B22C 1/18* (2006.01)
*B22C 1/10* (2006.01)

(52) U.S. Cl.
CPC ..... *B22C 1/188* (2013.01); *B22C 1/10* (2013.01)

(58) Field of Classification Search
CPC ..... B22C 1/10; B22C 1/18; B22C 1/188
See application file for complete search history.

(56) References Cited

U.S. PATENT DOCUMENTS

| | | | | |
|---|---|---|---|---|
| 2004/0192806 | A1 | 9/2004 | Kuhs | |
| 2005/0178522 | A1 | 8/2005 | Kurokawa et al. | |
| 2015/0231691 | A1* | 8/2015 | Tanaka | B22C 9/12 106/38.3 |
| 2016/0136724 | A1 | 5/2016 | Deters et al. | |
| 2016/0158828 | A1 | 6/2016 | Tanaka | |

FOREIGN PATENT DOCUMENTS

| | | | | | |
|---|---|---|---|---|---|
| CN | 1538887 | A | | 10/2004 | |
| CN | 1654141 | A | | 8/2005 | |
| CN | 102180883 | A | | 9/2011 | |
| CN | 102773401 | A | | 11/2012 | |
| CN | 104209450 | A | | 12/2014 | |
| CN | 104289661 | A | | 1/2015 | |
| CN | 105307796 | A | | 2/2016 | |
| CN | 105492138 | A | | 4/2016 | |
| CN | 106563764 | A | | 4/2017 | |
| EP | 0 675862 | | | 10/1995 | |
| GB | 872804 | A | * | 7/1961 | B22C 1/188 |
| JP | 48-53929 | A | | 7/1973 | |
| JP | 50-9524 | | | 1/1975 | |
| JP | 50-20543 | B | | 7/1975 | |
| JP | 53-81430 | A | | 7/1976 | |
| JP | 53-25803 | | | 7/1978 | |
| JP | 60-196245 | A | | 10/1985 | |
| JP | 2000-176612 | A | | 6/2000 | |
| JP | 2006-7319 | A | | 1/2006 | |
| WO | WO 2014/098129 | A1 | | 6/2014 | |
| WO | WO 2018/097180 | A1 | | 5/2018 | |

OTHER PUBLICATIONS

International Search Report, issued in PCT/JP2019/024948, dated Sep. 17, 2019.
Extended European Search Report for European Application No. 19834959.9, dated Apr. 5, 2022.
Chinese Office Action and Search Report for Chinese Application No. 201980046044.9, dated Feb. 15, 2023, with an English translation.
Chinese Office Action and Search Report for Chinese Application No. 201980046044.9, dated Dec. 22, 2021, with English translation of the Office Action.
Chinese Office Action and Search Report for Chinese Application No. 201980046044.9, dated Nov. 15, 2022, with English translation.

* cited by examiner

*Primary Examiner* — Michael P Wieczorek
(74) *Attorney, Agent, or Firm* — Birch, Stewart, Kolasch & Birch, LLP

(57) ABSTRACT

Inorganic coated sand in a dry state having refractory aggregate; and an inorganic binder layer formed on a surface of the refractory aggregate, in which the inorganic binder layer contains a metasilicate hydrate.

2 Claims, No Drawings

INORGANIC COATED SAND

TECHNICAL FIELD

The present invention relates to inorganic coated sand.

BACKGROUND ART

As a casting mold which is used for casting a cast metal, for example, a casting mold obtained by molding into a desired shape with the use of inorganic coated sand having refractory aggregate and an inorganic binder layer formed on a surface of the refractory aggregate has been known.

Examples of the technology related to such inorganic coated sand include those described in Patent Document 1 (Japanese Examined Patent Publication No. 53-025803), Patent Document 2 (International Publication No. WO2014/098129), and Patent Document 3 (International Publication No. WO2018/097180).

Patent Document 1 describes a producing method of a casting mold in which an alkali metasilicate solution prepared by previously adding caustic alkali to water glass is added to refractory particles such as silica sand and the resulting mixture is kneaded, or alcohols are further added during the kneading, crystalline alkali silicate is precipitated and deposited on surfaces of the refractory particles such as the silica sand, and then particulate blended sand obtained by adding and mixing fine-particle dust containing $SiO_2$ as a main component, generated during Fe—Si refining, is heated to at least a temperature equal to or higher than a melting point of the crystalline alkali silicate and cured.

Patent Document 2 describes coated sand in a dry state which has room-temperature fluidity, and is obtained by mixing a refractory aggregate that has been heated with a water glass aqueous solution as a binder and by evaporating the water such that a covering layer of the binder is formed on a surface of the refractory aggregate, and in which a water percentage thereof is adjusted to 0.5 mass % or less.

Patent Document 3 describes a technology related to coated sand in a dry coating state having room-temperature fluidity, in which a surface of refractory aggregate is covered with a covering layer containing water glass, and spherical particles are contained in the covering layer.

RELATED DOCUMENT

Patent Document

[Patent Document 1] Japanese Examined Patent Publication No. 53-025803

[Patent Document 2] International Publication No. WO2014/098129

[Patent Document 3] International Publication No. WO2018/097180

SUMMARY OF THE INVENTION

According to the present invention, there is provided inorganic coated sand in a dry state, having refractory aggregate and an inorganic binder layer formed on a surface of the refractory aggregate, in which the inorganic binder layer contains a metasilicate hydrate.

DESCRIPTION OF EMBODIMENTS

According to studies conducted by the inventors, inorganic coated sand according to the related art has been found to have room for improvement in view of fillability into a mold and a strength of a casting mold to be obtained. In addition, the inorganic coated sand according to the related art was required to be subjected to steam aeration when being cured, and a facility for steam aeration was required in the manufacturing of a casting mold. In addition, in the manufacturing of inorganic coated sand in a dry state, a water glass aqueous solution was used as a binder, and the water was required to be evaporated.

The present invention is contrived in view of the above circumstances, and relates to inorganic coated sand which makes it possible to realize an excellent fillability into a mold and a casting mold having excellent strength, and is not required to be subjected to steam aeration in the manufacturing of a casting mold. The present invention also relates to a method of manufacturing a casting mold, in which the inorganic coated sand is not required to be subjected to steam aeration when being cured. The present invention also relates to a method of manufacturing an inorganic coated sand which does not require the use of an aqueous solution of an inorganic binder in the manufacturing of inorganic coated sand, and thus does not require a water removing step.

The inventors have conducted intensive studies to realize inorganic coated sand which makes it possible to realize an excellent fillability into a mold and a casting mold having excellent strength. As a result, it has been found that with inorganic coated sand containing a metasilicate hydrate in an inorganic binder layer, an excellent fillability into a mold and a casting mold having excellent strength is obtainable. It has also been found that in the manufacturing of inorganic coated sand containing a metasilicate hydrate in an inorganic binder layer, it is not necessary to use an aqueous solution of a metasilicate hydrate, and thus a water removing step may be skipped. It has also been found that it is not necessary to perform steam aeration in the manufacturing of a casting mold, and thus facility simplification may be achieved.

Furthermore, according to the present invention, there is provided a method for manufacturing inorganic coated sand in a dry state, in which the inorganic coated sand has refractory aggregate and an inorganic binder layer formed on a surface of the refractory aggregate, in which the inorganic binder layer contains a metasilicate hydrate, the method including: a step (1) of obtaining a mixture by mixing the refractory aggregate with the metasilicate hydrate at a temperature equal to or higher than a melting point of the metasilicate hydrate; and a step (2) of cooling the mixture to a temperature lower than the melting point of the metasilicate hydrate.

Furthermore, according to the present invention, there is provided a casting mold which is formed from the inorganic coated sand.

Furthermore, according to the present invention, there is provided a method for manufacturing a casting mold including: a step (3) of filling a mold for providing a desired casting mold with the inorganic coated sand; and a step (4) of curing the inorganic coated sand by heating the mold filled with the inorganic coated sand without steam aeration.

According to the present invention, it is possible to realize an excellent fillability into a mold and a casting mold having excellent strength. In addition, since it is not necessary to use an aqueous solution of an inorganic binder in the manufacturing of inorganic coated sand, a water removing step may be skipped, and since it is not necessary to perform steam aeration in the manufacturing of the casting mold, inorganic coated sand making it possible to achieve facility simplification can be achieved.

Hereinafter, embodiments of the present invention will be described. In this specification, "A-B" ("A to B") indicating a numerical range represents a range of A or greater and B or less unless otherwise specified. The configurations and elements described in the respective embodiments may be appropriately combined as long as the effects of the present invention are not impaired.

[Inorganic Coated Sand (C)]

First, inorganic coated sand (C) according to the present embodiment will be described.

The inorganic coated sand (C) according to this embodiment is inorganic coated sand in a dry state, having refractory aggregate (A) and an inorganic binder layer (B) formed on a surface of the refractory aggregate (A), in which the inorganic binder layer (B) contains a metasilicate hydrate.

The reason why the above advantageous effects is exhibited when a metasilicate hydrate is used as an inorganic binder which forms the inorganic binder layer (B) is not clear, but is presumed as follows.

In a case where the inorganic binder layer (B) is a metasilicate hydrate, crystallinity of the inorganic binder layer (B) may be improved. Furthermore, the inorganic coated sand (C) is in a dry state, and excellent room-temperature fluidity and an improved strength of a casting mold are obtainable. In addition, since the metasilicate hydrate has a low melting point, it is not necessary to use an aqueous solution of the metasilicate hydrate in the manufacturing of the inorganic coated sand (C), and a water removing step may be skipped. In addition, since the inorganic binder is a metasilicate hydrate, it is not necessary to perform steam aeration in the manufacturing of a casting mold, and facility simplification may be achieved.

In this embodiment, the inorganic coated sand (C) is formed of a particle group of the inorganic coated sand, and the refractory aggregate (A) is formed of a particle group of the refractory particles.

The inorganic coated sand (C) is in a dry state. The coated sand in a dry state means coated sand in which regardless of the water content, a measured value is obtainable in the measurement of a dynamic angle of repose.

Here, the dynamic angle of repose may be measured by the following method. A cylindrical transparent plastic bottle is filled with the coated sand in an amount half the volume of the bottle, held such that an axis is kept horizontal, and rotated at a constant speed around the horizontal axis. A slope of the coated sand layer flowing in the cylinder becomes flat. An angle formed between the slope and a horizontal plane is measured.

The dynamic angle of repose is preferably 80° or less, more preferably 45° or less, and even more preferably 30° or less.

In a case where the coated sand does not flow in the cylinder, or the slope of the coated sand layer is not formed as a flat plane even when the coated sand flows, and as a result, the dynamic angle of repose cannot be measured, the sand is in a wet state.

A slump loss value of the inorganic coated sand (C) is preferably 90 mm or greater, more preferably 100 mm or greater, even more preferably 105 mm or greater, and still more preferably 108 mm or greater from the viewpoint of a further improvement in fillability into a mold and strength of a casting mold. Therefore, it is thought that the room-temperature fluidity of the inorganic coated sand (C) is improved, and as a result, the fillability into a mold is improved. Furthermore, it is thought that the strength of a casting mold can be increased as a result of the improvement of the fillability into a mold and the improvement of the binding property between the inorganic coated sand (C) particles.

The slump loss value of the inorganic coated sand (C) is preferably 140 mm or less, more preferably 130 mm or less, and even more preferably 120 mm or less from the viewpoint of an improvement in strength of a casting mold and handleability.

A slump flow value of the inorganic coated sand (C) is preferably 150 mm or greater, more preferably 200 mm or greater, even more preferably 230 mm or greater, and still more preferably 240 mm or greater from the viewpoint of a further improvement in fillability into a mold and strength of a casting mold.

The slump flow value of the inorganic coated sand (C) is preferably 500 mm or less, more preferably 400 mm or less, even more preferably 350 mm or less, and still more preferably 320 mm or less from the viewpoint of an improvement in strength of a casting mold and handleability.

Here, in this embodiment, in order to adjust the slump loss value or the slump flow value of the inorganic coated sand (C) within the above range, for example, it is necessary to highly control, the kind or content ratio of the refractory aggregate (A) or the inorganic binder which forms the inorganic binder layer (B), the manufacturing method of the inorganic coated sand (C), or the like.

More specifically, in this embodiment, examples of factors for controlling the slump loss value or the slump flow value of the inorganic coated sand (C) within the above range include using spherical aggregate as the refractory aggregate (A), using a metasilicate hydrate as the inorganic binder which forms the inorganic binder layer (B), and manufacturing the inorganic coated sand (C) by a method in which after coating of the refractory aggregate (A) with the inorganic binder, fluidity of the inorganic binder is reduced to fix the inorganic binder to the surface of the refractory aggregate (A).

The slump loss value and the slump flow value of the inorganic coated sand (C) may be measured in an environment of 25° C. and 55% relative humidity by a slump test using a slump cone having an inner diameter of 50 mm at an upper end, an inner diameter of 100 mm at a lower end, and a height of 150 mm according to JIS A 1101: 2014.

Here, the slump cone is formed to have such a shape that the cone is cut at a predetermined height position in a plane parallel to the bottom surface, and a part above the cut surface is extracted. The slump cone has the same shape as a slump cone which is used in the slump test according to JIS A1101: 2014, although having different dimensions. The inner diameter at the upper end and the inner diameter at the lower end refer to diameters of only the space portions of an upper end opening and a lower end opening, respectively, and exclude a thickness of the edge of the slump cone.

More specifically, the slump loss value and the slump flow value of the inorganic coated sand (C) may be measured by the following procedure.

(1) First, the slump cone is placed on a horizontal and smooth table, for example, a flat table such that the lower end opening is disposed on the lower side and the upper end opening is disposed on the upper side.

(2) Next, the inorganic coated sand (C) is poured into a hollow portion of the slump cone from the upper end opening such that the hollow inside the slump cone is filled with the inorganic coated sand (C). In this case, in a case where the inorganic coated sand (C) is poured during stirring with a metal rod or the like, the hollow can be filled with the inorganic coated sand (C) without entrainment of air. It is preferable to pour the inorganic coated sand (C) in several times such that the inorganic coated sand (C) gradually fills the slump cone, rather than to pour the inorganic coated sand (C) all at once.

(3) After the slump cone is filled with the inorganic coated sand (C), the upper surface of the inorganic coated sand (C) is aligned with the upper end of the slump cone to be smooth. That is, the upper end opening is aligned with the upper end surface of the inorganic coated sand (C) filling the slump cone.

(4) After filling with the inorganic coated sand (C), the slump cone is vertically pulled up. In a case where the slump cone is pulled up, it is pulled up such that at least the lower end opening is positioned above the height of the slump cone.

(5) When the slump cone is pulled up, the shape thereof formed by filling with the inorganic coated sand (C) begins to collapse due to its own weight, and eventually the collapse is stopped. A difference between a height $H_1$ of the original shape and $H_2$, where $H_2$ is a height from the uppermost portion to the lower end of the inorganic coated sand (C) when the collapse is stopped, that is, a value of $H_1$-$H_2$ is the slump loss value.

A difference between a diameter $L_1$ of the original shape and $L_2$, where $L_2$ is a diameter of the spread of the inorganic coated sand (C) when the collapse is stopped, that is, a value of $L_2$-$L_1$ is the slump flow value.

The inorganic coated sand (C) preferably has a spherical shape from the viewpoints of an improvement in fluidity and a further improvement in fillability into a mold. Here, the expression the inorganic coated sand (C) according to this embodiment has a spherical shape means that the sand has an annular shape such as a ball, and more specifically, means that the sphericity thereof is preferably 0.80 or greater, more preferably 0.85 or greater, even more preferably 0.90 or greater, still more preferably 0.95 or greater, and yet still more preferably 0.97 or greater. It is preferable that the sphericity of the inorganic coated sand (C) according to this embodiment is equal to or greater than the above lower limit from the viewpoints of an improvement in fluidity, quality of a casting mold, and strength of a casting mold and easiness of molding a casting mold.

The upper limit of the sphericity is, specifically, 1 or less.

The sphericity of the inorganic coated sand (C) may be obtained as follows: a particle image (photograph) obtained by an optical microscope or a digital scope (for example, model VH-8000 manufactured by KEYENCE CORPORATION) is analyzed to obtain an area of a projected cross-section of the particle and a circumferential length of the cross-section, [circumferential length (mm) of true circle having area same as that ($mm^2$) of projected cross-section of particle]/[circumferential length (mm) of projected cross-section of particle] is calculated, and values obtained for each of optional 50 particles are averaged.

The average particle diameter of the inorganic coated sand (C) is preferably 0.05 mm or greater, and more preferably 0.1 mm or greater from the viewpoints of an improvement in quality of a casting mold and strength of a casting mold and easiness of molding a casting mold. It is preferable that the average particle diameter of the inorganic coated sand (C) is equal to or greater than the above lower limit since the amount of the inorganic binder layer (B) to be used may be reduced in the manufacturing of a casting mold and regeneration of the inorganic coated sand (C) is thus facilitated.

The average particle diameter of the inorganic coated sand (C) is preferably 2 mm or less, more preferably 1 mm or less, and even more preferably 0.5 mm or less from the viewpoints of an improvement in quality of a casting mold and strength of a casting mold and easiness of molding a casting mold. It is preferable that the average particle diameter of the inorganic coated sand (C) is equal to or less than the above upper limit since porosity is reduced in the manufacturing of a casting mold, and the strength of a casting mold can be increased. In this embodiment, the average particle diameter of the inorganic coated sand (C) may be measured by the following method.

(Method of Measuring Average Particle Diameter)

In a case where the sphericity obtained from the projected cross-section of the particle is 1, the diameter (mm) is measured, and in a case where the sphericity is less than 1, a major axis diameter (mm) and a minor axis diameter (mm) of the particle aligned randomly are measured to obtain (major axis diameter+minor axis diameter)/2. Values obtained for each of optional 100 particles are averaged to define the average as the average particle diameter (mm). The major axis diameter and the minor axis diameter are defined as follows. When the particle is stabilized on a plane and the projected image of the particle on the plane is sandwiched by two parallel lines, a width of the particle in which the distance between the parallel lines is minimized is called the minor axis diameter, and a distance when the particle is sandwiched by two parallel lines perpendicular to the above parallel lines is called the major axis diameter.

The major axis diameter and the minor axis diameter of the particle may be obtained by taking an image (photograph) of the particle with an optical microscope or a digital scope (for example, model VH-8000 manufactured by KEYENCE CORPORATION) and analyzing the obtained image.

[Refractory Aggregate (A)]

The refractory aggregate (A) according to this embodiment may be natural sand or artificial sand.

Examples of the natural sand include silica sand containing quartz as a main component, chromite sand, zircon sand, olivine sand, and alumina sand.

Examples of the artificial sand include synthetic mullite sand, $SiO_2$-based foundry sand containing $SiO_2$ as a main component, $Al_2O_3$-based foundry sand containing $Al_2O_3$ as a main component, $SiO_2/Al_2O_3$-based foundry sand, $SiO_2$/MgO-based foundry sand, $SiO_2/Al_2O_3/ZrO_2$-based foundry sand, $SiO_2/Al_2O_3/Fe_2O_3$-based foundry sand, and foundry sand originating from slag. Here, the main component means a component contained in the largest amount among the components of the sand.

The artificial sand represents not any naturally produced foundry sand but any foundry sand obtained by artificially preparing components of metal oxides, and then melting or sintering the prepared components. In addition, recovered sand obtained by recovering the used refractory aggregate and regenerated sand obtained by subjecting the recovered sand to a regeneration treatment may also be used.

These may be used alone or in combination of two or more kinds thereof.

The refractory aggregate (A) according to this embodiment preferably contains at least one selected from the group consisting of $SiO_2$ and $Al_2O_3$ from the viewpoint of an improvement in strength of a casting mold.

The refractory aggregate (A) according to this embodiment is preferably artificial sand from the viewpoint of an improvement in strength of a casting mold, and among artificial sands, at least one selected from the group consisting of synthetic mullite sand, $SiO_2$-based foundry sand, $Al_2O_3$-based foundry sand, $SiO_2/Al_2O_3$-based foundry sand, $SiO_2/Al_2O_3/ZrO_2$-based foundry sand, and $SiO_2/Al_2O_3/Fe_2O_3$-based foundry sand is preferable.

From the viewpoints of an improvement in strength of a casting mold and fire resistance and of lower thermal expansibility, the refractory aggregate (A) preferably contains $SiO_2$ in an amount of mass % or greater, more preferably 60 mass % or greater, even more preferably 80 mass % or greater, and still more preferably 90 mass % or greater when a total content of all the components contained in the refractory aggregate (A) is 100 mass %.

The upper limit of the $SiO_2$ content of the refractory aggregate (A) is not limited, but is, for example, 100 mass % or less, and may be 99 mass % or less.

From the viewpoints of an improvement in strength of a casting mold and fire resistance and of lower thermal expansibility, the refractory aggregate (A) preferably contains $Al_2O_3$ in an amount of mass % or greater, more preferably 30 mass % or greater, even more preferably 40 mass % or greater, and still more preferably 50 mass % or greater when a total content of all the components contained in the refractory aggregate (A) is 100 mass %.

The upper limit of the $Al_2O_3$ content of the refractory aggregate (A) is not limited, but is, for example, 95 mass % or less, and preferably 85 mass % or less.

The content of each component such as $SiO_2$, $Al_2O_3$, and $Fe_2O_3$ in the refractory aggregate (A) may be measured using a known analysis method such as a wet weight method or a fluorescent X-ray method.

The amorphous degree of the refractory aggregate (A) is preferably 30% or greater, more preferably 50% or greater, even more preferably 65% or greater, and still more preferably 80% or greater from the viewpoints that the surface of the aggregate is made smoother and the strength of a casting mold is thus further improved, and that lower thermal expansibility is obtainable.

The upper limit of the amorphous degree of the refractory aggregate (A) is not limited, but is, for example, 100% or less, and may be 99% or less.

Various methods are used as a method of controlling the amorphous degree of the refractory aggregate (A), and in general, a manufacturing method in which a melted material is rapidly cooled is preferably used. For example, a method including: melting a raw material; air-granulating the melted material; and rapidly cooling the air-granulated material, or a method including: treating a raw material in the flame; and rapidly cooling the raw material. In any case, the cooling method may be appropriately selected at various rates according to the material and the particle diameter. A method of making a crystallized material amorphous through a heat treatment and a cooling treatment is also considered. Among these, those using a flame melting method, in which heating and cooling can be easily controlled, are preferable.

The amorphous degree of the refractory aggregate (A) may be obtained by an X-ray diffraction method shown below.

(X-Ray Diffraction Method)

The refractory aggregate (A) is pulverized in a mortar, and pressure-bonded to an X-ray glass holder of a powder X-ray diffraction apparatus for measurement. As the powder X-ray diffraction apparatus, MultiFlex (light source: CuKα ray, tube voltage: 40 kV, tube current: mA) manufactured by Rigaku Corporation was used, and the measurement was performed in a range of $2\theta=5°$ to 90° at a scanning interval of 0.01° and a scanning speed of 2°/min with slits DS 1, SS 1, RS 0.3 mm. Within a range of $2\theta=10°$ to 50°, the X-ray intensities on the low-angle side and the high-angle side are connected by a straight line, the area below the straight line is set as a background, the crystallinity is obtained using the software attached to the apparatus and subtracted from 100, and the result is defined as the amorphous degree. Specifically, with respect to the area above the background, the amorphous peak (halo) and each crystalline component are separated by curve fitting, and areas thereof are obtained to calculate the amorphous degree (%) by the following formula.

$$\text{Amorphous Degree (\%)}=\text{Area of Halo}/(\text{Area of Crystalline Component}+\text{Area of Halo})\times 100$$

The refractory aggregate (A) preferably has a spherical shape from the viewpoints of an improvement in fluidity of the inorganic coated sand (C) and a further improvement in fillability into a mold. Here, the expression the refractory aggregate (A) according to this embodiment has a spherical shape means that the aggregate has an annular shape such as a ball, and more specifically, means that the sphericity thereof is preferably 0.80 or greater, more preferably 0.85 or greater, even more preferably 0.90 or greater, still more preferably 0.95 or greater, and yet still more preferably 0.97 or greater. It is preferable that the sphericity of the refractory aggregate (A) according to this embodiment is equal to or greater than the above lower limit from the viewpoints of an improvement in fluidity, quality of a casting mold, and strength of a casting mold and easiness of molding a casting mold. Furthermore, it is preferable that the sphericity of the refractory aggregate (A) according to this embodiment is equal to or greater than the above lower limit from the viewpoints that the surface of the aggregate is made smoother, and as a result, the covering state of the inorganic binder layer (B) is improved, and a casting mold having a higher strength is obtainable.

The upper limit of the sphericity is, specifically, 1 or less. The sphericity of the refractory aggregate (A) may be measured by the same method as that for the sphericity of the inorganic coated sand (C).

The average particle diameter of the refractory aggregate (A) is preferably 0.05 mm or greater, and more preferably 0.1 mm or greater from the viewpoint of an improvement in quality of a casting mold and strength of a casting mold and easiness of molding of a casting mold. It is preferable that the average particle diameter of the refractory aggregate (A) is equal to or greater than the above lower limit since the amount of the inorganic binder layer (B) to be used may be reduced in the manufacturing of a casting mold and regeneration of the inorganic coated sand (C) is thus facilitated.

The average particle diameter of the refractory aggregate (A) is preferably 2 mm or less, more preferably 1 mm or less, and even more preferably 0.5 mm or less from the viewpoints of an improvement in quality of a casting mold and strength of a casting mold and easiness of molding a casting mold. It is preferable that the average particle diameter of the refractory aggregate (A) is equal to or less than the above upper limit since the porosity is reduced in the manufacturing of a casting mold, and the strength of a casting mold can be increased.

The average particle diameter of the refractory aggregate (A) may be measured by the same method as that for the average particle diameter of the inorganic coated sand (C).

[Inorganic Binder Layer (B)]

The inorganic binder which forms the inorganic binder layer (B) is a metasilicate hydrate. It is preferable to use a metasilicate hydrate since the crystallinity of the inorganic binder layer (B) can be improved, the inorganic coated sand (C) is in a dry state, and excellent room-temperature fluidity is obtainable. In a case where a metasilicate hydrate having a low melting point is used, the inorganic binder layer (B) may be formed on the surface of the refractory aggregate (A) without being dissolved in water. That is, in the manufacturing process of the inorganic coated sand (C), it is not necessary to use an aqueous solution of a metasilicate hydrate, and thus a water removing step may be skipped, and the manufacturing method may be simplified. In addition, since the inorganic binder is a metasilicate hydrate, it is not necessary to perform steam aeration in the manufacturing of a casting mold, and facility simplification may be achieved.

As the metasilicate hydrate, at least one selected from sodium metasilicate pentahydrate, sodium metasilicate nonahydrate, potassium metasilicate pentahydrate, and potassium metasilicate nonahydrate is preferable, and at least one selected from sodium metasilicate pentahydrate and sodium metasilicate nonahydrate is more preferable from the viewpoints described above.

The melting point of sodium metasilicate pentahydrate is 72° C., and the melting point of sodium metasilicate nonahydrate is 47° C. The amount of the inorganic binder layer (B) to be applied, contained in the inorganic coated sand (C), is, for example, 0.05 parts by mass or greater, preferably 0.1 parts by mass or greater, more preferably 0.5 parts by mass or greater, even more preferably 1 part by mass or greater, and still more preferably 2 parts by mass or greater with respect to 100 parts by mass of the refractory aggregate (A) from the viewpoint of provision of a high-strength casting mold.

In addition, the amount of the inorganic binder layer (B) to be applied, contained in the foundry sand composition (C), is, for example, 10 parts by mass or less, preferably 8 parts by mass or less, and more preferably 6 parts by mass or less with respect to 100 parts by mass of the refractory aggregate (A) from the viewpoint of provision of a high-strength casting mold.

The water content of the inorganic binder layer (B) contained in the inorganic coated sand (C) is preferably 60 parts by mass or greater, more preferably 65 parts by mass or greater, even more preferably 90 parts by mass or greater, and still more preferably 110 parts by mass or greater with respect to 100 parts by mass of the metasilicate from the viewpoints of provision of a high-strength casting mold and simple manufacturing of a casting mold. In addition, the water content is preferably 180 parts by mass or less, more preferably 160 parts by mass or less, even more preferably 150 parts by mass or less, and still more preferably 140 parts by mass or less from the viewpoints of improving fluidity and further improving fillability into a mold.

For example, in a case where the inorganic binder which forms the inorganic binder layer (B) is formed only of sodium metasilicate pentahydrate, the water content is 74 parts by mass, and in a case where the inorganic binder is formed only of sodium metasilicate nonahydrate, the water content is 133 parts by mass.

The inorganic coated sand (C) according to this embodiment may be molded alone or in combination with other known refractory aggregates or other additives, using a desired casting mold.

The inorganic coated sand (C) according to this embodiment may be used in combination with other additives such as a coupling agent, a lubricant, and a release agent.

The coupling agent is not limited, and examples thereof include a silane coupling agent, a zircon coupling agent, and a titanium coupling agent.

The lubricant is not limited, and examples thereof include waxes such as paraffin wax, synthetic polyethylene wax, and montanic acid wax; fatty acid amides such as stearic acid amide, oleic acid amide, and erucic acid amide; alkylene fatty acid amides such as methylene bis stearic acid amide and ethylene bis stearic acid amide; stearic acids; stearyl alcohols; metal stearates such as lead stearate, zinc stearate, calcium stearate, and magnesium stearate; monoglyceride stearates; stearyl stearates; and hardened oils.

The release agent is not limited, and examples thereof include paraffin, wax, light oil, machine oil, spindle oil, insulating oil, waste oil, vegetable oil, fatty acid ester, organic acid, graphite fine particles, mica, vermiculite, fluorine-based release agents, and silicone-based release agents.

The inorganic coated sand (C) according to this embodiment preferably further contains inorganic fine particles at least on or in the inorganic binder layer (B), and more preferably further contains inorganic fine particles on the inorganic binder layer (B). The inorganic coated sand (C) according to this embodiment may contain inorganic fine particles both on and in the inorganic binder layer (B).

Thus, the particles of the inorganic coated sand (C) are strongly bound to each other via the inorganic fine particles, and as a result, the strength of a casting mold to be obtained can be further improved.

Here, the inorganic fine particles on the inorganic binder layer (B) may be partially embedded in the inorganic binder layer (B).

The inorganic fine particles are not limited, and examples thereof include silica particles and silicon particles. From the viewpoint of an improvement in strength of a casting mold, silica particles are preferable, and amorphous silica particles are more preferable. The inorganic fine particles may be used alone or in combination of two or more kinds thereof.

In addition, in a case where silica particles are used as the inorganic fine particles, from the viewpoint of an improvement in melt binding property between the inorganic coated sand (C) particles, the refractory aggregate (A) preferably contains $SiO_2$ in an amount of 30 mass % or greater, more preferably 60 mass % or greater, even more preferably 80 mass % or greater, and still more preferably 90 mass % or greater when a total content of all the components contained in the refractory aggregate (A) is 100 mass %. The upper limit of the $SiO_2$ content in the refractory aggregate (A) is 100 mass % or less.

The amorphous degree of the amorphous silica particles is preferably 80% or greater, more preferably 90% or greater, even more preferably 93% or greater, and still more preferably 95% or greater from the viewpoint that the particles of the inorganic coated sand (C) are more strongly bound to each other via the inorganic fine particles.

The upper limit of the amorphous degree of the amorphous silica particles is not limited. The upper limit is, for example, 100% or less, and may be 99% or less.

An average particle diameter $d_{50}$ in a weight-based particle size distribution of the inorganic fine particles measured by a laser diffraction scattering particle size distribution measurement method is preferably 0.1 μm or greater, more preferably 0.3 μm or greater, even more preferably 0.4 μm or greater, and still more preferably 0.5 μm or greater from the viewpoints of an improvement in strength of a casting mold per unit mass and handleability, and is preferably 2.0 μm or less, more preferably 1.0 μm or less, and even more preferably 0.8 μm or less from the viewpoint of an improvement in strength of a casting mold per unit mass.

Here, the average particle diameter $d_{50}$ in a weight-based particle size distribution of the inorganic fine particles measured by a laser diffraction scattering particle size distribution measurement method may be obtained as follows: for example, the inorganic binder layer is dissolved in water to be removed from the coated sand, the inorganic fine particles are taken out, and the particle size of the obtained inorganic fine particles is measured by the laser diffraction scattering particle size distribution measurement method.

The average particle diameter $d_{50}$ in a weight-based particle size distribution of the inorganic fine particles measured by a laser diffraction scattering particle size distribution measurement method may also be provided by measuring the particle size of the inorganic fine particles as a raw material by the laser diffraction scattering particle size distribution measurement method.

The average particle diameter of the inorganic fine particles obtainable from an observation image of a scanning electron microscope is preferably 0.1 μm or greater, more preferably 0.3 μm or greater, and even more preferably 0.4 μm or greater from the viewpoint of an improvement in strength of a casting mold per unit mass and handleability, and is preferably 2.0 μm or less, more preferably 1.0 μm or less, and even more preferably 0.8 μm or less from the viewpoint of an improvement in strength of a casting mold per unit mass.

Here, various image analysis methods may be used to obtain the average particle diameter of the inorganic fine particles, which is obtained from an observation image of a scanning electron microscope. Irregular particles may be sorted as a preprocess. For example, after the inorganic binder layer and the inorganic fine particles are determined on the basis of the elements, 100 inorganic fine particles are optionally selected, and diameters thereof are measured. An average of particle diameters of 80 inorganic fine particles, excluding 10 particles counted in order of decreasing diameter from the maximum particle diameter and 10 particles counted in order of increasing diameter from the minimum particle diameter, that is, total 20 inorganic fine particles, may be defined as the average particle diameter of the inorganic fine particles.

In addition, the content of the inorganic fine particles contained in the inorganic coated sand (C) is preferably 0.1 parts by mass or greater, more preferably 0.2 parts by mass or greater, and is preferably 10 parts by mass or less, more preferably 5 parts by mass or less, and even more preferably 3 parts by mass or less with respect to 100 parts by mass of the refractory aggregate (A) from the viewpoints of an improvement in strength of a casting mold and handleability.

[Method for Manufacturing Inorganic Coated Sand (C)]

Next, a method for manufacturing the inorganic coated sand (C) according to this embodiment will be described.

The method for manufacturing the inorganic coated sand (C) is different from manufacturing methods of an inorganic coated sand according to the related art.

The method for manufacturing the inorganic coated sand (C) is a manufacturing method for preparing inorganic coated sand in a dry state, having refractory aggregate and an inorganic binder layer formed on a surface of the refractory aggregate.

The inorganic binder layer contains a metasilicate hydrate.

The inorganic coated sand (C) according to this embodiment may be obtained by, for example, a manufacturing method including the following steps (1) and (2).

Step (1): A step of obtaining a mixture by mixing the refractory aggregate (A) with the metasilicate hydrate (B) at a temperature equal to or higher than a melting point of the metasilicate hydrate Step (2): A step of cooling the mixture to a temperature lower than the melting point of the metasilicate hydrate According to the method for manufacturing the inorganic coated sand (C) according to this embodiment, the inorganic binder layer (B) can be crystallized, and thus inorganic coated sand (C) having excellent fluidity is obtainable, in comparison with a manufacturing method according to the related art. Furthermore, since it is not necessary to use an aqueous solution of a metasilicate hydrate, a dehydration step is not required, and the manufacturing method of the inorganic coated sand (C) may be simplified.

In the step (1), specifically, a surface of the refractory aggregate (A) is coated with a fluidized metasilicate hydrate at a temperature equal to or higher than a melting point of the metasilicate hydrate.

Examples of the method of mixing the refractory aggregate (A) with the metasilicate hydrate at a temperature equal to or higher than the melting point of the metasilicate hydrate include a method [step (1A)] in which the metasilicate hydrate is added to the refractory aggregate (A) heated to a temperature equal to or higher than the melting point of the metasilicate hydrate, and the refractory aggregate (A) and the metasilicate hydrate are mixed while the metasilicate hydrate is melted, and a method [step (1B)] in which the metasilicate hydrate melted by heating is added to and mixed with the refractory aggregate (A).

Among these, the step (1B) is preferable from the viewpoint of shortening the coating time.

From the same viewpoint, in the step (1), it is preferable that the metasilicate hydrate is mixed without being previously made into an aqueous solution. In addition, it is preferable that the step (1) does not include a step of intentionally adding water.

The mixing conditions such as the stirring speed and the processing time in the mixing of the refractory aggregate (A) with the metasilicate hydrate may be appropriately determined according to the amount of the mixture to be treated.

In the step (2), the mixture obtained in the step (1) is cooled to a temperature lower than the melting point of the metasilicate hydrate to reduce the fluidity of the metasilicate hydrate, and the metasilicate hydrate is fixed to the surface of the refractory aggregate (A). Therefore, a metasilicate hydrate layer, that is, the inorganic binder layer (B) is formed.

The method for manufacturing the inorganic coated sand (C) may further include a step of mixing the inorganic coated sand obtained in the step (2) with the inorganic fine particles.

The inorganic coated sand (C) according to this embodiment may be obtained by the above method.

[Casting Mold]

Next, a casting mold according to this embodiment will be described.

The casting mold according to this embodiment is formed from the inorganic coated sand (C).

A method for manufacturing the casting mold includes the following steps (3) and (4).

Step (3): A step of filling a mold for providing a desired casting mold with the inorganic coated sand (C)

Step (4): A step of curing the inorganic coated sand by heating the mold filled with the inorganic coated sand (C) without steam aeration Preferably, the mold is previously kept warm by heating in the step (3) from the viewpoint of an improvement in productivity of casting mold. The heating temperature is preferably 100° C. or higher, and more preferably 150° C. or higher, and is preferably 300° C. or lower, and more preferably 250° C. or lower from the viewpoints of an improvement in productivity of a casting mold and an improvement in strength of a casting mold.

In the step (4), the mold filled with the inorganic coated sand (C) is heated without steam aeration. In a case where the inorganic coated sand (C) according to this embodiment is used, the inorganic coated sand (C) may be cured without steam aeration, and a facility for steam aeration or the like is not required.

The heating temperature is preferably 100° C. or higher, and more preferably 150° C. or higher, and is preferably 300° C. or lower, and more preferably 250° C. or lower from the viewpoints of an improvement in productivity of a casting mold and an improvement in strength of a casting mold. The heating time is preferably 30 seconds or longer, and more preferably 60 seconds or longer, and is preferably 600 seconds or shorter from the viewpoint of stably providing strength of a casting mold.

The embodiments of the present invention have been described as above, but these are merely examples of the present invention, and various configurations other than the above configurations may be employed.

The present invention is not limited to the above-described embodiments, and the present invention includes modifications, improvements, and the like within a scope in which the object of the present invention can be achieved.

Regarding the above-described embodiments, the present invention further discloses the following inorganic coated sand, method for manufacturing inorganic coated sand, and method for manufacturing casting mold.

<1> Inorganic coated sand in a dry state, having refractory aggregate and an inorganic binder layer formed on a surface of the refractory aggregate, in which the inorganic binder layer contains a metasilicate hydrate, and has a water content of 60 parts by mass or greater and 140 parts by mass or less with respect to 100 parts by mass of the metasilicate, the refractory aggregate contains at least one selected from the group consisting of $SiO_2$ and $Al_2O_3$, and the inorganic coated sand has an average particle diameter of 0.05 mm or greater and 2 mm or less.

<2> An inorganic coated sand in a dry state, having refractory aggregate and an inorganic binder layer formed on a surface of the refractory aggregate, in which the inorganic binder layer contains at least one selected from sodium metasilicate pentahydrate and sodium metasilicate nonahydrate, and has a water content of 60 parts by mass or greater and 140 parts by mass or less with respect to 100 parts by mass of the metasilicate, the refractory aggregate contains at least one selected from the group consisting of $SiO_2$ and $Al_2O_3$, and the inorganic coated sand has an average particle diameter of 0.05 mm or greater and 2 mm or less, and a sphericity of 0.80 or greater.

<3> Inorganic coated sand in a dry state, having refractory aggregate and an inorganic binder layer formed on a surface of the refractory aggregate, in which the inorganic binder layer contains at least one selected from sodium metasilicate pentahydrate and sodium metasilicate nonahydrate, and has a water content of 60 parts by mass or greater and 140 parts by mass or less with respect to 100 parts by mass of the metasilicate, the refractory aggregate contains at least one selected from the group consisting of $SiO_2$ and $Al_2O_3$, and has an amorphous degree of 30% or greater, an amount of the inorganic binder layer to be applied is 0.5 parts by mass or greater and 10 parts by mass or less with respect to 100 parts by mass of the refractory aggregate, and the inorganic coated sand has an average particle diameter of 0.05 mm or greater and 2 mm or less, and a sphericity of 0.80 or greater.

<4> The inorganic coated sand according to any one of <1> to <3>, in which inorganic fine particles having an average particle diameter of 0.1 μm or greater and 2.0 μm or less are further contained in an amount of 0.2 parts by mass or greater and 3 parts by mass or less with respect to 100 parts by mass of the refractory aggregate at least on or in the inorganic binder layer.

<5> The inorganic coated sand according to any one of <1> to <3>, in which silica having an average particle diameter of 0.1 μm or greater and 2.0 μm or less is further contained in an amount of 0.2 parts by mass or greater and 3 parts by mass or less with respect to 100 parts by mass of the refractory aggregate at least on or in the inorganic binder layer.

<6> A method for manufacturing inorganic coated sand in a dry state, the inorganic coated sand having refractory aggregate and an inorganic binder layer formed on a surface of the refractory aggregate, in which the inorganic binder layer contains a metasilicate hydrate, the method including: a step (1) of obtaining a mixture by mixing the refractory aggregate with the metasilicate hydrate at a temperature equal to or higher than a melting point of the metasilicate hydrate without previously making the metasilicate hydrate into an aqueous solution; and a step (2) of cooling the mixture to a temperature lower than the melting point of the metasilicate hydrate.

<7> A method for manufacturing inorganic coated sand in a dry state, the inorganic coated sand having refractory aggregate and an inorganic binder layer formed on a surface of the refractory aggregate, in which the inorganic binder layer contains a metasilicate hydrate, the metasilicate hydrate is at least one selected from sodium metasilicate pentahydrate and sodium metasilicate nonahydrate, the refractory aggregate contains at least one selected from the group consisting of $SiO_2$ and $Al_2O_3$, and the refractory aggregate has an average particle diameter of 0.05 mm or greater and 2 mm or less, and a sphericity of 0.80 or greater, the method including: a step (1) of obtaining a mixture by mixing the refractory aggregate with the metasilicate hydrate at a temperature equal to or higher than a melting point of the metasilicate hydrate without previously making the metasilicate hydrate into an aqueous solution; and a step (2) of cooling the mixture to a temperature lower than the melting point of the metasilicate hydrate.

<8> A method for manufacturing inorganic coated sand in a dry state, the inorganic coated sand having refractory aggregate and an inorganic binder layer formed on a surface of the refractory aggregate, in which the inorganic binder layer contains a metasilicate hydrate, the metasilicate hydrate is at least one selected from sodium metasilicate pentahydrate and sodium metasilicate nonahydrate, the refractory aggregate contains at least one selected from the group consisting of $SiO_2$ and $Al_2O_3$, and the refractory aggregate has an average particle diameter of 0.05 mm or greater and 2 mm or less, and a sphericity of 0.80 or greater, the method including: a step (1) of obtaining a mixture by mixing the refractory aggregate with the metasilicate hydrate in an amount of 0.5 parts by mass or greater and 10 parts or less by mass with respect to 100 parts by mass of the refractory aggregate at a temperature equal to or higher than a melting point of the metasilicate hydrate without previously making the metasilicate hydrate into an aqueous solution; and a step (2) of cooling the mixture to a temperature lower than the melting point of the metasilicate hydrate.

<9> The method for manufacturing inorganic coated sand according to any one of <6> to <8>, further including a step of mixing the inorganic coated sand obtained in the step (2) with inorganic fine particles having an average particle diameter of 0.1 μm or greater and 2.0 μm or less in an amount of 0.2 parts by mass or greater and 3 parts by mass or less with respect to 100 parts by mass of the refractory aggregate.

<10> The method for manufacturing inorganic coated sand according to anyone of <6> to <8>, further including a step of mixing the inorganic coated sand obtained in the step (2) with silica having an average particle diameter of 0.1 μm or greater and 2.0 μm or less in an amount of 0.2 parts by mass or greater and 3 parts by mass or less with respect to 100 parts by mass of the refractory aggregate.

<11> A method for manufacturing a casting mold including: a step (3) of filling a mold for providing a desired casting mold with the inorganic coated sand according to any one of <1> to <5>; and a step (4) of curing the inorganic coated sand by heating the mold filled with the inorganic coated sand without steam aeration.

EXAMPLES

Hereinafter, the present invention will be described with reference to examples and comparative examples, but is not limited thereto.

[1] Measurement Method

First, a measurement method in the following examples and comparative examples will be described.

(1) Average Particle Diameters of Refractory Aggregate and Inorganic Coated Sand (or Kneaded Sand)

In a case where the sphericity obtained from a projected cross-section of a particle was 1, the diameter (mm) was measured, and in a case where the sphericity was less than 1, a major axis diameter (mm) and a minor axis diameter (mm) of the particle aligned randomly were measured to obtain (major axis diameter+minor axis diameter)/2. Values obtained for each of optional 100 particles were averaged to define the average as an average particle diameter (mm).

The major axis diameter and the minor axis diameter of the particle were obtained by taking an image (photograph) of the particle with a digital scope (model VH-8000 manufactured by KEYENCE CORPORATION) and analyzing the obtained image.

(2) Average Particle Diameter of Inorganic Fine Particles

A particle size distribution of inorganic fine particles was measured by a laser diffraction method using a laser diffraction scattering particle size distribution measurement apparatus. From the measurement results, a particle diameter ($d_{50}$, average particle diameter) of the inorganic fine particles at a cumulative percentage of 50% in the weight-based cumulative distribution was obtained.

(3) Chemical Composition Ratio of Refractory Aggregate

The composition ratio of each component in the refractory aggregate was measured by a fluorescent X-ray method.

(4) Amorphous Degree of Refractory Aggregate

The refractory aggregate was pulverized in a mortar, and pressure-bonded to an X-ray glass holder of a powder X-ray diffraction apparatus for measurement. As the powder X-ray diffraction apparatus, MultiFlex (light source: CuKα ray, tube voltage: 40 kV, tube current: 40 mA) manufactured by Rigaku Corporation was used, and the measurement was performed in a range of 2θ=5° to 90° at a scanning interval of 0.01° and a scanning speed of 2°/min with slits DS 1, SS 1, RS 0.3 mm. Within a range of 2θ=10° to 50°, the X-ray intensities on the low-angle side and the high-angle side were connected by a straight line, the area below the straight line was set as a background, the crystallinity was obtained using the software attached to the apparatus and subtracted from 100, and the result was defined as the amorphous degree. Specifically, with respect to the area above the background, the amorphous peak (halo) and each crystalline component were separated by curve fitting, and areas thereof were obtained to calculate the amorphous degree (%) by the following formula.

$$\text{Amorphous Degree (\%)} = \text{Area of Halo}/(\text{Area of Crystalline Component} + \text{Area of Halo}) \times 100$$

(5) Sphericity of Inorganic Coated Sand (or Kneaded Sand)

The sphericities of the refractory aggregate and the inorganic coated sand (or kneaded sand) were obtained as follows: a particle image (photograph) obtained by a digital scope (model VH-8000 manufactured by KEYENCE CORPORATION) was analyzed to obtain an area of a projected cross-section of the particle and a circumferential length of the cross-section, [circumferential length (mm) of true circle having area same as that ($mm^2$) of projected cross-section of particle]/[circumferential length (mm) of projected cross-section of particle] was calculated, and values obtained for each of optional 50 particles were averaged.

(6) Slump Loss Value and Slump Flow Value of Inorganic Coated Sand (or Kneaded Sand)

The slump loss value and the slump flow value of the inorganic coated sand (or kneaded sand) were measured in an environment of 25° C. and 55% relative humidity by a slump test using a slump cone having an inner diameter of 50 mm at an upper end, an inner diameter of 100 mm at a lower end, and a height of 150 mm according to JIS A 1101: 2014.

(7) Dry State or Wet State of Inorganic Coated Sand or Kneaded Sand

A cylindrical transparent plastic bottle having a diameter of 76 mm and a height of 125 mm was filled with the coated sand in an amount half the volume of the bottle, held such that an axis was kept horizontal, and rotated at room temperature (25° C.) and a speed of rpm around the horizontal axis. The dry state was represented as a case where a slope of the coated sand layer or the kneaded sand layer flowing in the cylinder became flat, and an angle (dynamic angle of repose) formed between the slope and the horizontal plane could be measured. The wet state was represented as a case where the coated sand or the kneaded sand did not flow in the cylinder, or the slope of the coated sand layer or the kneaded sand layer was not formed as a flat plane even when the coated sand layer or the kneaded sand layer flowed, whereby the dynamic angle of repose could not be measured.

[2] Evaluation Method

Next, evaluation methods in the following examples and comparative examples will be described.

(1) Preparation of Casting Mold

Using the inorganic coated sands (or kneaded sands) obtained in the examples and the comparative examples, casting molds were prepared by the following methods. In any method, the preparation was carried out under the condition that no steam aeration was performed.

Small Mold (Pressurization)

A horizontal mold with 5 cavities capable of molding a test piece of 10×10×60 mm, heated to 200° C., was filled with the coated sand (or kneaded sand) under pressure with a trowel, kept to heat for 10 minutes for curing, and then test pieces were obtained.

Small Mold (Pouring)

The coated sand (or kneaded sand) was poured into a horizontal mold with 5 cavities of 10×10×60 mm, heated to 200° C., kept to heat for 10 minutes to be cured, and then test pieces were obtained.

Blowing

Using a CSR-43 blow molding machine, a mold (with 5 cavities) for test pieces of 22.3×22.3×180 mm, heated to 200° C., was blow-filled in a vertical direction at a blow pressure of 0.45 MPa. Then, heating was performed for curing for 10 minutes, and test pieces were obtained.

(2) Density of Casting Mold

A weight of the test piece was measured and divided by a volume calculated by dimension measurement to calculate a density of a casting mold.

(3) Bending Strength of Casting Mold

For the test pieces obtained by using the small mold, a digital force gauge ZTS-500N was attached to a vertical electric measuring stand manufactured by Imada Co., Ltd., and the measurement was performed by a method according to JACT test method SM-1. For the test pieces obtained by blow molding, a PBV transverse strength measuring attachment was attached to a PFG universal strength testing machine manufactured by Georg Fischer Ltd.

(4) Filling Rate

The density of the test piece obtained was divided by the bulk density of the coated sand (or kneaded sand) and multiplied by 100, and the result was defined as a filling rate.

[3] Materials

Next, materials used in the following examples and comparative examples will be described.

(1) Refractory Aggregate

Refractory Aggregate 1: silica sand (R6 manufactured by Mikawa Keiseki K.K.)

Refractory Aggregate 2: artificial sand prepared by electromelting method (ESPEARL60L manufactured by YAMAKAWA SANGYO CO., LTD.)

Refractory Aggregate 3: spherical molten silica (prepared by spheroidizing natural silica sand by flame fusion method)

Refractory Aggregate 4: mullite-based artificial sand (LUNAMOS MS #60 manufactured by Kao Corporation)

Table 1 shows properties of the refractory aggregates 1 to 4.

TABLE 1

| | Particle | | | | | | |
|---|---|---|---|---|---|---|---|
| | | Chemical Composition Ratio [mass %] | | | Amorphous Degree | Average Particle Diameter | |
| | Method | $SiO_2$ | $Al_2O_3$ | $Fe_2O_3$ | [%] | [μm] | Sphericity |
| Refractory Aggregate 1 | Natural | 98.6 | 0.4 | 0.2 | 0.2 | 200 | 0.85 |
| Refractory Aggregate 2 | Electromelting and Air-Granulating Method | 13.7 | 78.8 | 1.7 | 45 | 241 | 0.97 |
| Refractory Aggregate 3 | Flame Fusion Method | 98.9 | 0.8 | 0.1 | >95 | 200 | 0.89 |
| Refractory Aggregate 4 | Flame Fusion Method | 32 | 63 | 1 | 72 | 200 | 0.98 |

(2) Inorganic Binder

Inorganic Binder 1: sodium metasilicate nonahydrate ($Na_2SiO_3$ $0.9H_2O$), melting point 47° C.

Inorganic Binder 2: water glass aqueous solution A (water glass aqueous solution in which sodium silicate ($SiO_2$/$Na_2O$=2.1) is diluted with water to give a solid content (in which water is removed from water glass aqueous solution) concentration of 35 mass %)

(3) Inorganic Fine Particles

Inorganic Fine Particles 1: amorphous silica particles (average particle diameter $d_{50}$: 0.4 μm)

Inorganic fine particles 2: amorphous silica particles (average particle diameter $d_{50}$: 0.6 μm)

Example 1

The refractory aggregate 1 heated to a temperature of 105° C. was put into a stirring apparatus, and then cooled to 65° C. Then, the inorganic binder 1 was added at a ratio of 5 parts by mass with respect to the refractory aggregate 1 (100 parts by mass), and kneaded while being cooled to room temperature (25° C.) to crystallize and pulverize the inorganic binder 1, and thus coated sand 1 in a dry state was obtained. The obtained coated sand 1 was evaluated as described above. The obtained results are shown in Table 2.

Examples 2 to 4

Coated sands 2 to 4 in a dry state were obtained in the same manner as in Example 1, except that the refractory aggregates 2 to 4 were used instead of the refractory aggregate 1 as the refractory aggregate. The obtained coated sands 2 to 4 were evaluated as described above. The obtained results are shown in Table 2.

Example 5

Coated sand 5 in a dry state was obtained in a manner such that the coated sand 2 (105 parts by mass) obtained in Example 2 and the inorganic fine particles 1 (1 part by mass) were put into a stirring apparatus, and then mixed by stirring at a temperature of 25° C. to apply the inorganic fine particles 1 to the inorganic binder layer of the coated sand 2. The obtained coated sand 5 was evaluated as described above. The obtained results are shown in Table 2.

Examples 6 and 7

Coated sands 6 to 7 in a dry state were obtained in the same manner as in Example 5, except that the coated sands 3 and 4 were used instead of the coated sand 2. The obtained coated sands 6 to 7 were evaluated as described above. The obtained results are shown in Table 2.

Example 8

Coated sand 8 in a dry state was obtained in the same manner as in Example 6, except that the inorganic fine particles 2 were used instead of the inorganic fine particles 1. The obtained coated sand 8 was evaluated as described above. The obtained results are shown in Table 2.

Comparative Example 1

Kneaded sand 1 in a wet state was obtained in a manner such that the refractory aggregate 1 heated to a temperature of 25° C. was put into a stirring apparatus, and then the inorganic binder 2 was added at a ratio of 1.2 parts by mass with respect to the refractory aggregate 1 (100 parts by mass) and kneaded for 1 minute. The obtained kneaded sand 1 was evaluated as described above. The obtained results are shown in Table 2.

Comparative Example 2

Kneaded sand 2 in a wet state was obtained in the same manner as in Comparative Example 1, except that the refractory aggregate 2 was used instead of the refractory aggregate 1 as the refractory aggregate. The obtained kneaded sand 2 was evaluated as described above. The obtained results are shown in Table 2.

Comparative Example 3

Coated sand 9 in a dry state was obtained in a manner such that the refractory aggregate 2 heated to a temperature of 120° C. was put into a stirring apparatus, and then the inorganic binder 2 was added at a ratio of 1.2 parts by mass with respect to the refractory aggregate 2 (100 parts by mass) and kneaded to be pulverized while being dried to remove the water in the inorganic binder 2. The obtained coated sand 9 was evaluated as described above. The obtained results are shown in Table 2.

TABLE 2

| | Refractory Aggregate | Inorganic Binder | Inorganic Fine Particles | State of Coated Sand | Slump Loss Value (mm) | Slump Flow Value (mm) | Average Particle Diameter (mm) |
|---|---|---|---|---|---|---|---|
| Example 1 | Refractory Aggregate 1 | Inorganic Binder 1 | — | Dry | 107 | 220 | 0.200 |
| Example 2 | Refractory Aggregate 2 | Inorganic Binder 1 | — | Dry | 112 | 290 | 0.241 |
| Example 3 | Refractory Aggregate 3 | Inorganic Binder 1 | — | Dry | 116 | 250 | 0.200 |
| Example 4 | Refractory Aggregate 4 | Inorganic Binder 1 | — | Dry | 110 | 250 | 0.200 |
| Example 5 | Refractory Aggregate 2 | Inorganic Binder 1 | Inorganic Fine Particles 1 | Dry | 109 | 270 | 0.241 |
| Example 6 | Refractory Aggregate 3 | Inorganic Binder 1 | Inorganic Fine Particles 1 | Dry | 110 | 250 | 0.200 |
| Example 7 | Refractory Aggregate 4 | Inorganic Binder 1 | Inorganic Fine Particles 1 | Dry | 111 | 300 | 0.200 |
| Example 8 | Refractory Aggregate 3 | Inorganic Binder 1 | Inorganic Fine Particles 2 | Dry | 108 | 250 | 0.200 |
| Comparative Example 1 | Refractory Aggregate 1 | Inorganic Binder 2 | — | Wet | 84 | 100 | 0.200 |
| Comparative Example 2 | Refractory Aggregate 2 | Inorganic Binder 2 | — | Wet | 69 | 60 | 0.241 |
| Comparative Example 3 | Refractory Aggregate 2 | Inorganic Binder 2 | — | Dry | 116 | 258 | 0.241 |

| | | Small Mold (pressurization) | | Small Mold (pouring) | | Blowing | |
|---|---|---|---|---|---|---|---|
| | Sphericity | Density ($g/cm^3$) | Bending Strength (MPa ) | Density ($g/cm^3$) | Bending Strength (MPa ) | Filling Rate (%) | Bending Strength (MPa ) |
| Example 1 | 0.85 | 1.45 | 2.96 | 1.34 | 1.70 | 100 | 0.80 |
| Example 2 | 0.97 | 1.81 | 5.12 | 1.72 | 3.60 | 100 | 2.39 |

TABLE 2-continued

| | | | | | | | |
|---|---|---|---|---|---|---|---|
| Example 3 | 0.89 | 1.22 | 5.65 | 1.14 | 3.90 | 100 | 3.64 |
| Example 4 | 0.98 | 1.69 | 4.84 | 1.59 | 3.04 | 100 | 3.24 |
| Example 5 | 0.97 | 1.87 | 12.59 | 1.67 | 7.63 | 100 | 6.49 |
| Example 6 | 0.89 | 1.34 | 12.21 | 1.20 | 9.09 | 100 | 8.05 |
| Example 7 | 0.98 | 1.71 | 11.57 | 1.58 | 8.12 | 100 | 7.98 |
| Example 8 | 0.89 | 1.45 | 21.57 | 1.25 | 12.50 | 100 | 10.44 |
| Comparative Example 1 | *1 | 1.27 | 1.43 | *2 | *2 | 94 | 0.61 |
| Comparative Example 2 | *1 | 1.79 | *3 | *2 | *2 | 84 | *3 |
| Comparative Example 3 | 0.97 | *4 | *4 | *4 | *4 | *4 | *4 |

*1: The measurement value was not obtained since the sand aggregates in a wet state and did not form a particle shape.
*2: The measurement was not possible since the sand could not be naturally poured due to the wet state.
*3: The measurement value was not obtained since the filling rate was poor and accurate comparison was not possible.
*4: The measurement value was not obtained since the sand was not cured and the casting mold was not formed.

The inorganic coated sands in a dry state in Examples 1 to 8 had a higher filling rate than the kneaded sands in a wet state in Comparative Examples 1 and 2, and was thus excellent in fillability into a mold. The casting molds obtained using the inorganic coated sands in a dry state in Examples 1 to 8 had a higher bending strength than the casting molds obtained using the kneaded sands in a wet state in Comparative Examples 1 and 2, and thus had an excellent strength. The coated sand in a dry state in Comparative Example 3 was not cured under the condition that no steam aeration was performed.

As described above, it has been confirmed that the inorganic coated sand according to this embodiment makes it possible to realize an excellent fillability into a mold and a casting mold having excellent strength. It has been confirmed that the inorganic coated sand according to this embodiment is cured even under the condition that no steam aeration is performed, and thus it has been found that it is possible to achieve simplification of a facility or the like. It has been found that the inorganic coated sand according to this embodiment can be manufactured without the use of an aqueous solution of the inorganic binder, and the manufacturing of the inorganic coated sand does not require a water removing step.

The invention claimed is:

1. A method for manufacturing inorganic coated sand in a dry state, the inorganic coated sand having refractory aggregate and an inorganic binder layer formed on a surface of the refractory aggregate, wherein the inorganic binder layer comprises a metasilicate hydrate, and wherein amount of the inorganic binder layer to be applied is 0.05 parts by mass or greater and 10 parts by mass or less with respect to 100 parts by mass of the refractory aggregate, the method comprising:

a step (1) of obtaining a mixture by mixing the refractory aggregate with the metasilicate hydrate at a temperature equal to or higher than a melting point of the metasilicate hydrate; and a step (2) of cooling the mixture to a temperature lower than the melting point of the metasilicate hydrate; and wherein in the step (1) the metasilicate hydrate is previously melted before being added to and mixed with the refractory aggregate.

2. A method for manufacturing inorganic coated sand in a dry state, the inorganic coated sand having refractory aggregate and an inorganic binder layer formed on a surface of the refractory aggregate, wherein the inorganic binder layer comprises a metasilicate hydrate, and wherein amount of the inorganic binder layer to be applied is 0.05 parts by mass or greater and 10 parts by mass or less with respect to 100 parts by mass of the refractory aggregate, the method comprising:

a step (1) of obtaining a mixture by mixing the refractory aggregate with the metasilicate hydrate at a temperature equal to or higher than a melting point of the metasilicate hydrate; and a step (2) of cooling the mixture to a temperature lower than the melting point of the metasilicate hydrate; and wherein in the step (1), the metasilicate hydrate is mixed without being previously made into an aqueous solution.

* * * * *